US005150414A

United States Patent [19]

Ng

[11] Patent Number: 5,150,414

[45] Date of Patent: Sep. 22, 1992

[54] METHOD AND APPARATUS FOR SIGNAL PREDICTION IN A TIME-VARYING SIGNAL SYSTEM

[75] Inventor: Kam W. Ng, Barrington, R.I.

[73] Assignee: The United States of America as represented by the Secretary of the Navy, Washington, D.C.

[21] Appl. No.: 678,580

[22] Filed: Mar. 27, 1991

[51] Int. Cl.[5] ..... G10L 5/00

[52] U.S. Cl. ..... 381/47; 381/71

[58] Field of Search ..... 381/47, 71

[56] References Cited

U.S. PATENT DOCUMENTS 3,786,188 1/1974 Allen ..... 381/47
4,630,304 12/1986 Borth ..... 381/47
4,783,817 11/1988 Hamada ..... 381/71

*Primary Examiner*—Emanuel S. Kemeny
*Attorney, Agent, or Firm*—Michael J. McGowan; Prithvi C. Lall; Michael F. Oglo

[57] ABSTRACT

A method and apparatus for signal prediction using the estimate-maximize (EM) algorithm in a time-varying signal system is provided. A time function is used to appropriately weight, in complementary fashion, the significance of both the complete and incomplete data sets used by the EM algorithm over a time period of interest. Initially, the EM solution is based solely on the complete data set. As time progresses, the significance of the complete data set in the solution decreases while the significance of the incomplete data set increases. By the end of the time period of interest, the EM solution is based solely on the incomplete data set. The rate of decrease of significance of the complete data set, and complementary increase in significance of the incomplete data set, are controlled by the characteristics of the time function. The method is particularly useful in the area of active noise control where an open-loop response is provided by off-line predictive models of the time-varying noise signals to form the complete data set and where a closed-loop adaptive response forms the incomplete data set.

14 Claims, 3 Drawing Sheets

METHOD AND APPARATUS FOR SIGNAL PREDICTION IN A TIME-VARYING SIGNAL SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to signal prediction and more particularly to a method and apparatus for signal prediction in a time-varying signal system.

(2) Description of the Prior Art

Currently, the cancellation of time-varying noise signals has been made possible by a breakthrough in the field of active noise control. Specifically, applicant's recently filed U.S. patent application, copending Ser. No. 07/573415, incorporated herein by reference, teaches the combining of open and closed-loop responses to cancel the time-varying noise signal. The approach models the noise field (from both on-line data generated from the actual noise field, and off-line data from a historical data base) at any point as a stochastic process. To adaptively estimate the characteristics of this process, one of several algorithms may be used. One such algorithm is the estimate-maximize (EM) algorithm.

The EM algorithm iteratively obtains a Maximum Likelihood (ML) estimate of the unknown parameters using the notion of complete and incomplete date sets. The ML estimation is regarded as the optimal method for parameter estimation. Given a set of observed (incomplete) data z, the ML estimate of the vector of unknown parameters $\theta$ is defined as $$\theta_{ML} = \arg_\theta \max \log f_z(z;\theta) \tag{1}$$

where $\log f_z(z;\theta)$ is the logarithm of the likelihood function of z, and $f_z(z;\theta)$ is the probability density function of z for a given set of parameters $\theta$. Because the parameter vector $\theta$ contains several unknowns and $\log f_z(z;\theta)$ is generally a nonlinear function of $\theta$, the maximization of equation (1) tends-to be very complex.

Accordingly, the EM algorithm is used to find the ML estimate based on complete and incomplete data sets. The observed data set z is treated as the incomplete data while the complete data set y is such that:

$$z = H(y) \tag{2}$$

where H is a non-invertible (many-to-one) transformation. The EM algorithm is an iterative method that starts with an initial guess $\theta^0$, and then inductively calculates $\theta^L$ in two steps, namely, the estimate step (E-step) and the maximize step (M-step) defined as follows:

$$\begin{aligned} E\text{-step: } & Q^L(\theta) = E_y\{f_y(y;\theta \mid z;\ \theta^{(L-1)}\} \\ M\text{-step: } & \theta^L = \arg_\theta \max Q^L(\theta) \end{aligned} \tag{3}$$

The EM algorithm is not uniquely defined since the transformation H relating the complete data set y to the incomplete data set z can be any non-invertible transformation. Thus, there are many possible complete data specifications that will generate the incomplete (observed) data. However, H should be chosen such that the M-step is computationally simple thereby reducing the time for each iteration. At the same time, the resulting complete data must be sufficiently correlated with the incomplete data to guarantee a fast rate of convergence.

The rate of convergence of the EM algorithm depends on the cross-correlation or covariance of the complete data with the incomplete data. Also, the majority of the time required for solution convergence lies in the first maximization step. Accordingly, the speed of convergence for the complete solution depends greatly on the value of the initial estimate $\theta^0$.

SUMMARY OF THE INVENTION

Accordingly, it is an object of the present invention to provide a method and apparatus for decreasing the convergence time required by the initial maximization step of the estimate-maximize (EM) algorithm.

Another object of the present invention is to provide an initial estimate of the EM algorithm's incomplete data set based on the complete data set.

Still another object of the present invention is to adapt the EM algorithm for use in an active noise control system that combines open and closed-loop responses to cancel time-varying signals.

Other objects and advantages of the present invention will become more obvious hereinafter in the specification and drawings.

In accordance with the present invention, a method and apparatus for signal prediction using the estimate-maximize (EM) algorithm in a time-varying signal system is provided. The method uses complete and incomplete data sets as parameters for the algorithm. A time function is selected based on the characteristics of the time-varying signals over a time period of interest from t=0 to T. The time function selected is indicative of percentages of both the complete and incomplete data sets as a function of time such that the incomplete (or observed) data set percentage is the complement of the complete data set percentage. The estimate and maximize steps of the EM algorithm are then performed based on the selected percentages.

BRIEF DESCRIPTION OF THE DRAWING(s)

FIG. 4(*b*) is a graphical representation of a time function that experiences a linear decay of open-loop (complete data set) response according to the method of the present invention; and FIG. 4(*c*) is a graphical representation of a time function that experiences a slow exponential decay of open-loop (complete data set) response according to the method of the present invention.

DESCRIPTION OF THE PREFERRED EMBODIMENT(s)

The improved method and apparatus for signal prediction using the estimate-maximize (EM) algorithm in a time-varying signal system will now be described with reference to an active noise control (ANC) system. However, it is to be understood that the present invention applies equally as well to any of the time-varying signal systems that utilize complete and incomplete data sets.

Figure 1:
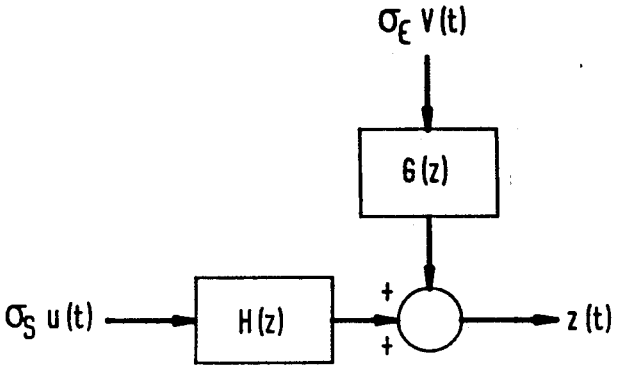
FIG. 1 is a block diagram of the stochastic process as it applies to a noise field typically encountered by an active noise control system.

In designing an ANC system, the noise field is best modeled as a stochastic process. The stochastic process reflects the noise generation due to random acoustic sources, excitations and vibrations. A model of the stochastic process is shown in FIG. 1 where z(t) is the unwanted noise signal, v(t) is a white process, G(z) is an all-zero filter, H(z) is a pole-zero filter, u(t) is a white process independent of v(t), and $\sigma_\epsilon$ and $\sigma_s$ are unknown parameters or coefficients. Both G(z) and H(z) can be either time invariant or time-varying. The coefficients or parameter vectors of H(z) and G(z), as well as the values of $\sigma_\epsilon$ and $\sigma_s$, are all unknowns to be determined. The EM algorithm has typically been used in the art to iteratively find the Maximum Likelihood (ML) estimate of all the unknowns. Thus, z(t) forms the incomplete data set of the EM algorithm.

Figure 2:
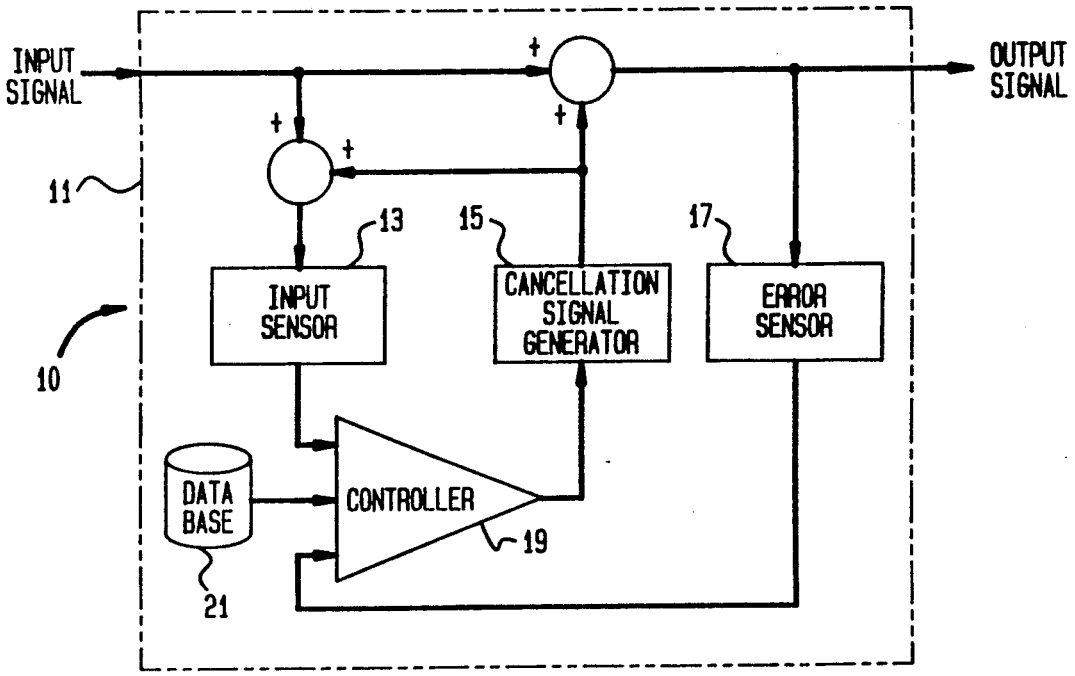
FIG. 2 is a block diagram of the copending application open/closed-loop response active noise control system.

Referring again to the drawings, and in particular now to FIG. 2, a typical active noise control system 10 is shown. The ANC system 10 consists of: a physical system 11 that receives an input signal which typically includes a time-varying noise signal component; an input sensor 13; a cancellation signal generator 15; an error sensor 17; a controller 19; and a data base 21. For airborne noise, sensors 13 and 17 are typically microphones while cancellation signal generator 15 is typically a speaker. For waterborne noise, sensors 13 and 17 are typically hydrophones while cancellation signal generator 15 is typically a sound projector.

In this ANC system, the controller 19 receives a combination of the input sensor signal, information from data base 21, and an error sensing signal. Data base 21 contains off-line predictive modeling of the input signal. Controller 19 is provided with the EM algorithm. The resulting solution generated by controller 19 causes a 180° out of phase signal to be input to the sound field within the physical system 11 via the cancellation signal generator 15. The input sensor signal includes feedback from cancellation signal generator 15. Error sensor 17 measures the residual acoustic signal that is used to adjust the filter coefficients of controller 19. Thus, the input and error sensor signals are closed-loop inputs to controller 19. In contrast, the information provided by data base 21 is an open-loop input to controller 19. Additional description of this open/closed-loop response ANC system can be found in applicant's previously filed patent application.

In terms of the EM algorithm, the input sensor signal is used in combination with the data base information to provide a basis for the initial estimate $\theta^0$ at the start of the noise cancellation when t=0. Since there is no feedback to the input sensor or error sensor signal at t=0, the combined input sensor signal and data base information comprise the only input to controller 19. Thus, at t=0, the system is only capable of generating an open-loop response. At a time t>0, the error sensor signal updates the filter coefficients of controller 19 and, accordingly, allows the system to generate a closed-loop response in addition to the open-loop response. In EM algorithm terminology, the open-loop data is the complete data set while the closed-loop data is the incomplete data set. However, for purposes of clarity, the ensuing discussion will use the open/closed-loop terminology.

Figure 3:
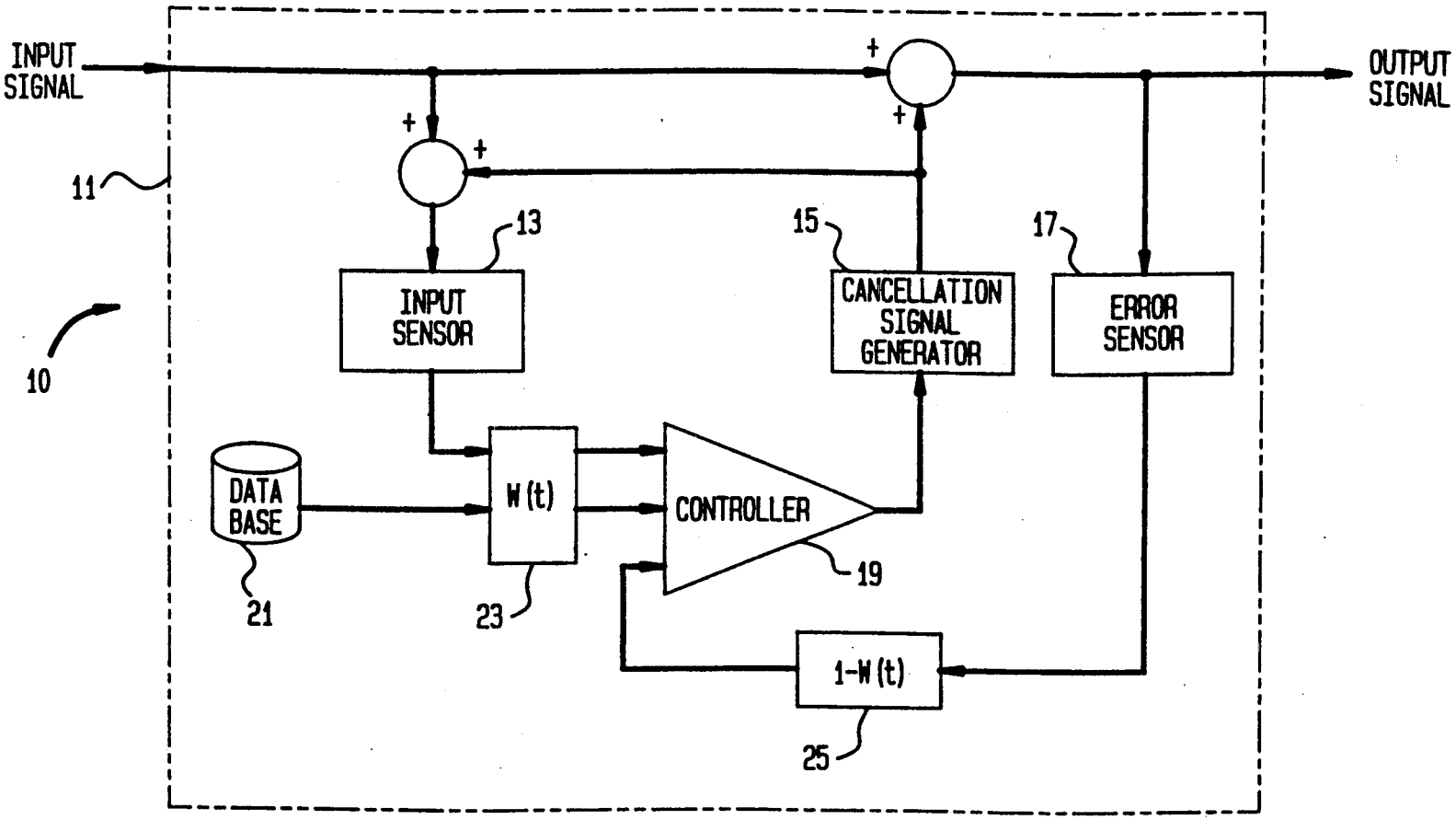
FIG. 3 is a block diagram of the open/closed-loop response active noise control system employing a time function in the signal prediction process according to the method of the present invention.

Proper control of the open and closed-loop responses over time can significantly reduce the time required for the EM algorithm to converge. Convergence time is critical since the ANC system must be able to cancel time-varying signals that are short in duration. Accordingly, the method of the present invention uses a time function w(t) to appropriately weight the percentage of open and closed-loop response input to controller 19 during a time period of interest. Specifically, the open-loop response, consisting of the combined input sensor signal and data base information, is weighted by a multiplier 23 by an amount w(t) as shown in FIG. 3. In FIG. 3 like reference numerals have been used for elements common to FIG. 2. The closed-loop response, consisting of the error signal, is weighted by a multiplier 25 by an amount equal to the complement of w(t) or 1-w(t).

Figure 4A:
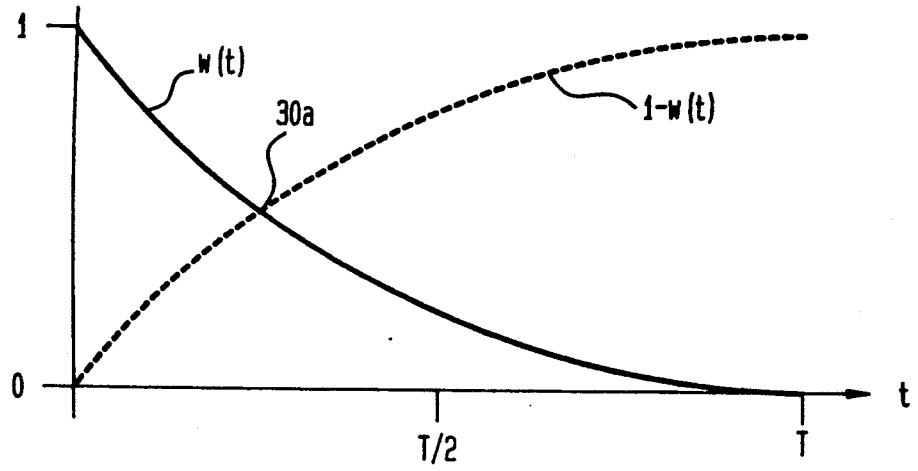
FIG. 4(*a*) is a graphical representation of a time function that experiences a rapid exponential decay of open-loop (complete data set) response according to the method of the present invention.
Figure 4B:
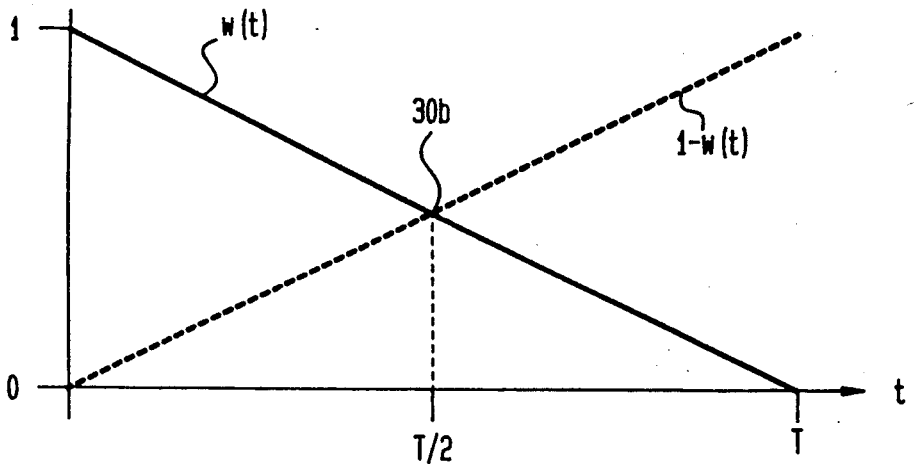
Figure 4C:
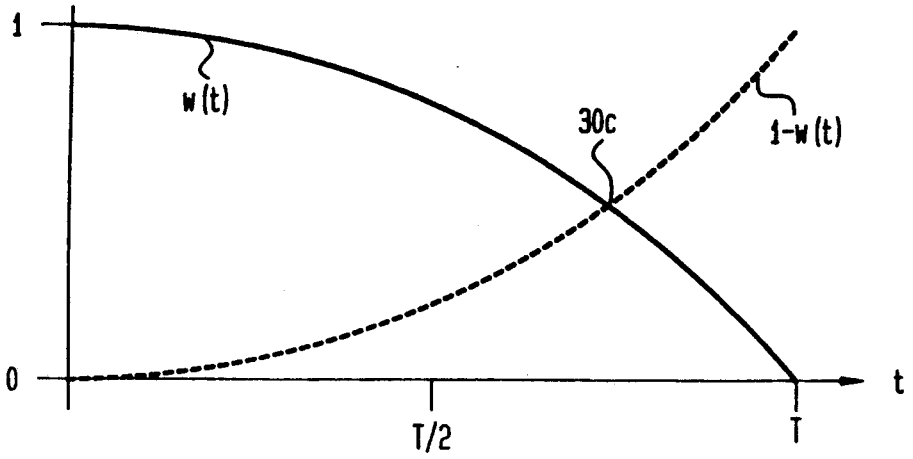

FIG. 4(*a*),(*b*) and (*c*) show three possible embodiments of time function w(t) and the respective complement 1-w(t), for t=0 to T, where T represents the time period of interest. In terms of ANC, T is typically the time required for the noise to be canceled. In general, the time function w(t) affecting the open-loop response exhibits decaying characteristics as w(t) ranges in value from 1 (t=0) to 0 (t=T). Conversely, the time function complement 1-w(t) affecting the closed-loop response exhibits complementary growth characteristics as 1-w(t) ranges in value from 0 (t=0) to 1 (t=T). In other words, at t=0, the EM solution is based solely on open-loop data, while at t=T, the EM solution is based solely on closed-loop data. In EM terminology, at t=0, 100% of the complete data set is used as the input to the EM algorithm and at t=T, 100% of the incomplete data set is used as the input to the EM algorithm.

Between t=0 and t=T, the EM solution is based on a combination of open and closed-loop data. In all cases, as time progresses, the open-loop response decreases in significance as the closed-loop response takes over. The point at which the closed-loop response becomes more significant is defined as the transition point such that 1-w(t)=w(t). Each transition point for each respective w(t) is indicated as 30*a*, 30*b* and 30*c*. The timing of each transition point is different depending on the choice of w(t). In particular, if the significance of the open-loop response decays rapidly early in the process as in FIG. 4(*a*), transition point 30*a* occurs at a time t<T/2. If the significance of the open-loop response decays slowly early in the process, as in FIG. 4(*c*), transition point 30*b* occurs at t>T/2. Finally, if the significance of the open-loop response decays linearly, as in FIG. 4(*b*), transition point 30*b* occurs at t=T/2.

The exponential decay characteristics of w(t) in FIGS. 4(*a*) and (*c*) behave according to the well-known quadratic equation $$w(t)=at^2+bt+c \tag{4}$$

With the above-noted requirements at t=0 and t=T, the time function w(t) becomes:

$$w(t)=-(1+bT)(t/T)^2+bt+1 \tag{5}$$

where b is the slope at t=0. Since the open-loop response of FIG. 4(*a*) decays more rapidly than FIG. 4(*c*), the value of b in FIG. 4(*a*) is greater than in FIG. 4(*c*). Specifically, the values of b are:

$b > -1/T$ for FIG. 4(*a*), and $b < -1/T$ for FIG. 4(*c*).

The linear decay characteristics of w(t) in FIG. 4(*b*) behave according to the well-known linear equation $$w(t) = mt + k \tag{6}$$

With the above-noted requirements at t=0 and t=T, the time function w(t) becomes:

$$w(t) = 1 - t/T \tag{7}$$

The choice of time function w(t) depends on the growth, decay and duration of the time-varying noise signals. The rapid exponential decay of w(t) represented by FIG. 4(*a*) is used when the time-varying noise signal exhibits a signal variance that is more than one standard deviation during the time period of interest. Note that one standard deviation is equivalent to a 95% confidence level. However, a slow exponential decay of w(t), represented by FIG. 4(*c*), is desired if the time-varying noise signal exhibits a signal variance that is less than one standard deviation during the time period of interest. Finally, the linear decay of w(t), represented by FIG. 4(*b*), is used when the time-varying noise signal exhibits a signal variance that is approximately equal to one standard deviation during the time period of interest. The linear decay is also chosen if nothing is known about the time-varying noise signals to be canceled.

The advantages of the present invention are numerous. By appropriately weighting the open-loop (complete data set) and closed-loop (incomplete data set) inputs to the EM algorithm, solution convergence time can be greatly reduced. The weighting scheme employed by the present invention provides the EM algorithm with initial parameter estimates based on the complete data set. This allows for a good initial estimate in most instances, since there are many possible complete data specifications that will generate the incomplete data. As time progresses, the significance of the complete data set in the solution convergence is reduced as the significance of the incomplete data set grows in a complementary fashion. The method also allows for a choice of weighting schemes based on the characteristics of the time-varying signals during the time period of interest.

While the foregoing has addressed itself to time-varying signal systems, it could be used equally as well in a system involving steady state noise. The method is applicable to a wide range of ANC systems to include fluidborne or structureborne noise cancellation as well as modification of turbulence structures in a flow field. Finally, the method can be extended to signal estimation and prediction using the EM algorithm for any time-varying signal system that utilizes complete and incomplete data sets.

It will thus be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of signal prediction in a time-varying signal system using the estimate-maximize (EM) algorithm, comprising the steps of:

providing the EM algorithm with complete and incomplete data sets;

selecting a time function based on the characteristics of time-varying signals over a time period of interest from t=0 to T, said time function indicative of a percentage of the complete data set and a percentage of the incomplete data set, both percentages being a function of time, wherein the incomplete data set percentage is the complement of the complete data set percentage;

performing the estimate and maximize steps of the EM algorithm during the time period of interest using the selected percentages of the complete and incomplete data sets.

2. A method as in claim 1 wherein the characteristics of the time-varying signals include the growth rate, decay rate and duration of the time-varying signals over the time period of interest.

3. A method as in claim 1 wherein, at t=0, the percentage of the complete data set is 100% and the percentage of the incomplete data set is 0%, and wherein, at t=T, the percentage of the complete data set is 0% and the percentage of the incomplete data set is 100%.

4. A method as in claim 3, wherein the time-varying signals exhibit a signal variance that is more than one standard deviation during the time period of interest such that the percentage of both the complete and incomplete data sets is 50% at a time $t < T/2$.

5. A method as in claim 3, wherein the time-varying signals exhibit a signal variance that is approximately equal to one standard deviation during the time period of interest such that the percentage of both the complete and incomplete data sets is 50% at a time $t = T/2$.

6. A method as in claim 3, wherein the time-varying signals exhibit a signal variance that is less than one standard deviation during the time period of interest such that the percentage of both the complete and incomplete data sets is 50% at a time $t > T/2$.

7. A method as in claim 4 wherein the percentage of the complete data set decays exponentially over the time period of interest and the percentage of the incomplete data set grows exponentially over the time period of interest.

8. A method as in claim 5 wherein the percentage of the complete data set decays linearly over the time period of interest and the percentage of the incomplete data set grows linearly over the time period of interest.

9. A method as in claim 6 wherein the percentage of the complete data set decays exponentially over the time period of interest and the percentage of the incomplete data set grows exponentially over the time period of interest.

10. A method as in claim 1 wherein the time-varying signal system is an active noise control system and the time period of interest is the time allotted to cancel the time-varying noise.

11. An apparatus for signal prediction in a time-varying signal system using the estimate-maximize (EM) algorithm, comprising:

means for generating complete and incomplete data sets for use as inputs to the EM algorithm;

means for weighting the complete and incomplete data set inputs wherein the incomplete data set weight is the complement of the complete data set weight; and means for processing the EM algorithm based on the weighted complete and incomplete data sets wherein the output of said processing means is the signal prediction.

12. An apparatus as in claim 11 wherein said generating means includes at least an open-loop response to the time-varying signal system.

13. An apparatus as in claim 12 wherein the open-loop response is at least partially provided by a historical data base that stores predictions of a plurality of time-varying signals.

14. An apparatus as in claim 11 wherein said weighting means comprises a complete data set multiplier and an incomplete data set multiplier.

* * * * *